US006591764B1

(12) United States Patent
Dean

(10) Patent No.: US 6,591,764 B1
(45) Date of Patent: Jul. 15, 2003

(54) POKER TABLE DROP BOX COVER

(76) Inventor: Ethan Dean, 1710 S. Gilbert Rd., #2213, Mesa, AZ (US) 85204

( * ) Notice: Subject to any disclaimer, the term of this patent is extended or adjusted under 35 U.S.C. 154(b) by 0 days.

(21) Appl. No.: 09/954,630

(22) Filed: Sep. 14, 2001

(51) Int. Cl.[7] ..... A47B 13/08
(52) U.S. Cl. ..... 108/90; 108/27
(58) Field of Search ..... 108/90, 27; 150/158

(56) References Cited

U.S. PATENT DOCUMENTS 3,729,037 A * 4/1973 Dare et al.
4,708,183 A * 11/1987 Figueroa
5,195,197 A * 3/1993 Gutierrez et al.
5,776,085 A * 7/1998 Stone et al.
5,799,975 A * 9/1998 Crick
5,908,681 A * 6/1999 Foster
6,036,287 A * 3/2000 Kim
6,044,774 A * 4/2000 Gelbart
2002/0029421 A1 * 3/2002 Sereboff

FOREIGN PATENT DOCUMENTS

DE 2733982 * 2/1979

* cited by examiner

*Primary Examiner*—José V. Chen
(74) *Attorney, Agent, or Firm*—Joseph N. Breaux

(57) ABSTRACT

A cover for covering a poker table drop box that includes a padded cover having cushioning along the edges and corners an which is securable to a drop box using a fast release securing mechanism such as magnets.

1 Claim, 2 Drawing Sheets

POKER TABLE DROP BOX COVER

TECHNICAL FIELD

The present invention relates to safety equipment and more particularly to a poker table drop box cover for use with casino poker tables that include a drop box for receiving and holding chips and/or money; the poker table drop box cover being constructed from a padded material and that is sized and shaped to wrap around the drop box and which is provided with a securing mechanism such as magnets or the like for securing the cover in place in a readily and rapidly removable manner; the cover material includes extra padded areas at the corners and edges thereof that include gel filled or thick rubber strips to provide additional protection to players sitting on either side of the dealer, as well as the dealer him/her self, so that the knees or hands of the players and the dealer are not injured by contacting or bumping against the edges and/or corners of the box.

BACKGROUND OF INVENTION

Casino poker tables incorporate a drop box for holding money which the dealer takes in prior to distributing poker chips to a player. The drop box is constructed from thick heavy metal for securing the money from theft and typically includes sharp corners and edges which can cause injury to the players sitting adjacent to the dealer, as well as the dealer him/her self, when the knees or hands of the player or dealer strike the side of the drop box. It would be a benefit, therefore, to have a cover for cushioning the edges and corners of the drop box to prevent injury to the player. In addition, because security purposes, the cover should be removable rapidly and the mechanism for holding the cover in place should be one such as magnets which would allow for the rapid removal of the cover when it is time to empty the drop box.

SUMMARY OF INVENTION

It is thus an object of the invention to provide a poker table drop box cover that is constructed from a padded material and that is sized and shaped to wrap around the drop box and which is provided with a securing mechanism such as magnets or the like for securing the cover in place in a readily and rapidly removable manner; the cover material includes extra padded areas at the corners and edges thereof that include gel filled or thick rubber strips to provide additional protection to players sitting on either side of the dealer, as well as the dealer him/her self, so that the knees or hands of the players and the dealer are not injured by contacting or bumping against the edges and/or corners of the box.

Accordingly, a poker table drop box cover is provided. The poker table drop box cover is constructed from a padded material and that is sized and shaped to wrap around the drop box and which is provided with a securing mechanism such as magnets or the like for securing the cover in place in a readily and rapidly removable manner; the cover material includes extra padded areas at the corners and edges thereof that include gel filled or thick rubber strips to provide additional protection to players sitting on either side of the dealer, as well as the dealer him/her self, so that the knees or hands of the players and the dealer are not injured by contacting or bumping against the edges and/or corners of the box.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
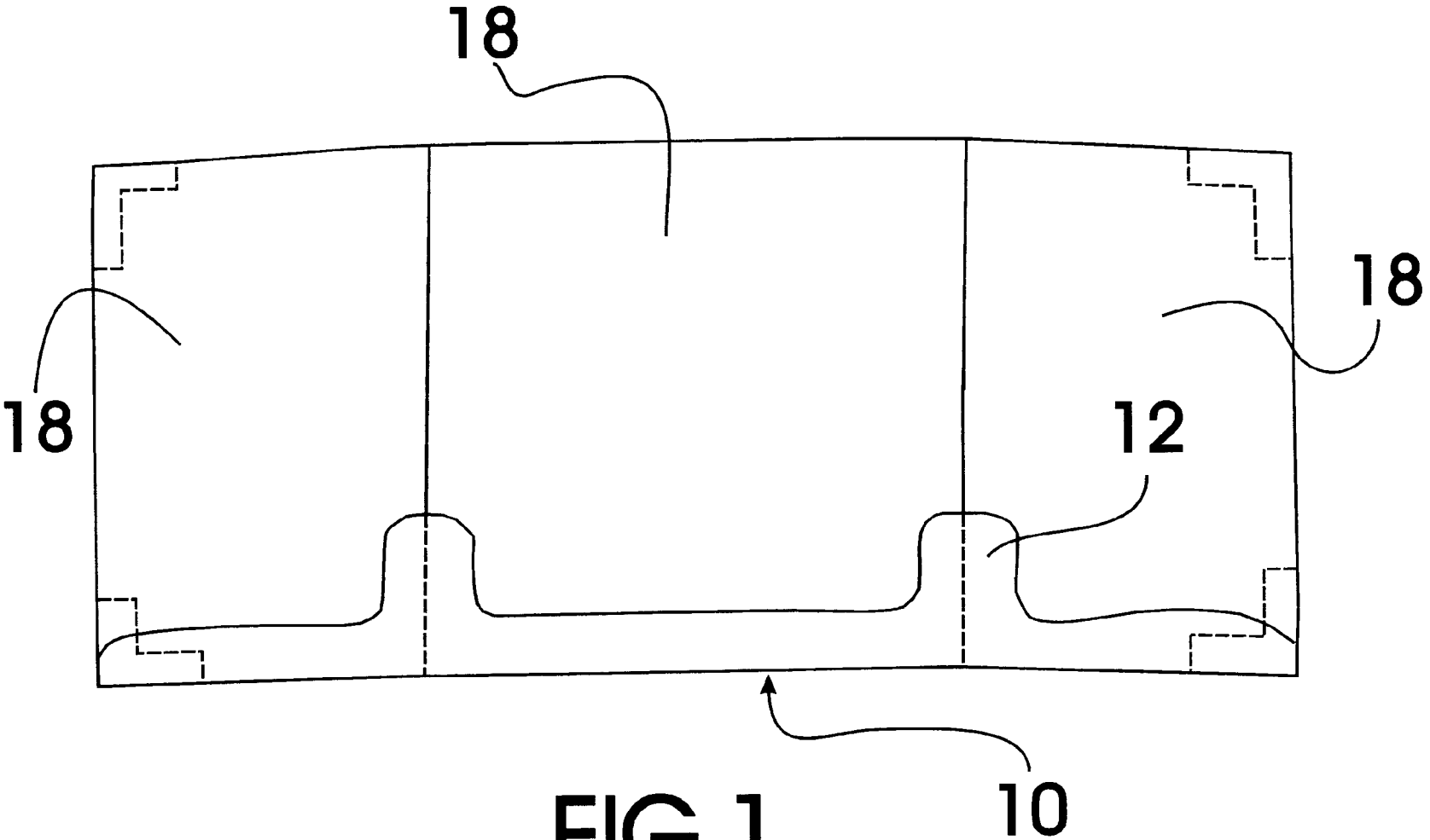
FIG. 1 is a front plan view of an exemplary embodiment of the poker table box cover of the present invention.
Figure 2:
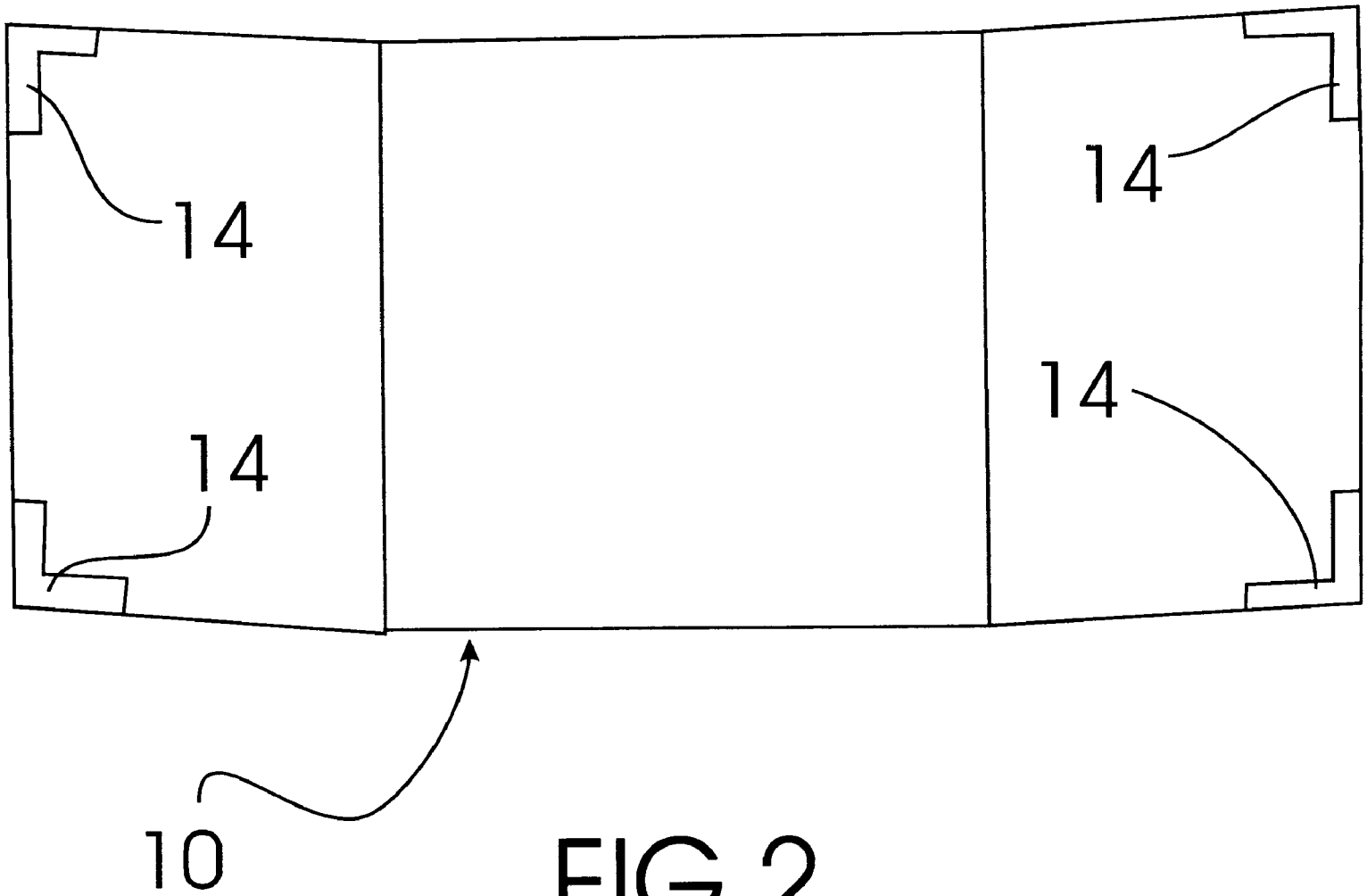
FIG. 2 is a back plan view of the poker table drop box cover of the present invention.

FIGS. 1 and 2 show various aspects of an exemplary embodiment of the poker table drop box cover of the present invention generally designated 10. Poker table drop box cover 10 is constructed from a padded material sized and shaped to wrap around a drop box of a poker table. Cover 10 includes extra padded areas 12 that are provided for padding areas such as edges and/or corners of the drop box. The extra padding includes gel filled bladders or thick rubber strips. Drop box cover 10 is securable in place with magnets 14 to allow for easy and rapid installation and removal of drop box cover 10. The exterior facing sidewalls 18 of cover 10 can optionally include advertising and the like thereon.

It can be seen from the preceding description that a poker table drop box cover has been provided.

It is noted that the embodiment of the poker table drop box cover described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A drop box cover for covering the drop box of a poker table, particularly a drop box having drop box edges and drop box corners that is secured to a poker table, to protect the dealer and players seated next to the dealer from injuring themselves by accidently banging into the drop box, the exposed drop box edges or the drop box corners; the drop box cover comprising:

a poker table drop box cover constructed from a padded material, sized and shaped to wrap around the drop box and which is provided with a securing mechanism for securing the poker table drop box cover;

the poker table drop box cover being constructed from padded material and including extra padded areas at poker table drop box covering corners and edges thereof that, each poker table drop box covering corner and edge including gel filled strips to provide additional protection resulting from contacting or bumping against drop box edges and drop box corners of drop box over which the poker table drop box cover is secured.

* * * * *